US007407310B2

(12) United States Patent
Komatsu

(10) Patent No.: US 7,407,310 B2
(45) Date of Patent: Aug. 5, 2008

(54) VEHICULAR HEADLAMP

(75) Inventor: Motohiro Komatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/636,835

(22) Filed: Dec. 11, 2006

(65) Prior Publication Data

US 2007/0159839 A1 Jul. 12, 2007

(30) Foreign Application Priority Data

Dec. 28, 2005 (JP) ..... 2005-380433

(51) Int. Cl.
*F21V 1/00* (2006.01)

(52) U.S. Cl. ..... 362/509; 362/516; 362/517; 362/518; 362/519; 362/520; 362/538; 362/539; 362/522

(58) Field of Classification Search ..... None
See application file for complete search history.

(56) References Cited

U.S. PATENT DOCUMENTS 1,355,876 A * 10/1920 Winston ..... 362/339
6,416,210 B1 * 7/2002 Uchida ..... 362/539
6,951,365 B2 * 10/2005 Chase et al. ..... 296/187.03
7,134,774 B2 * 11/2006 Iwasaki ..... 362/517
2005/0174794 A1 * 8/2005 Kagiyama ..... 362/538
2005/0190572 A1 9/2005 Komatsu et al.
2005/0225995 A1 * 10/2005 Komatsu et al. ..... 362/512
2005/0248955 A1 * 11/2005 Nishizawa et al. ..... 362/514

* cited by examiner

*Primary Examiner*—Sandra O'Shea
*Assistant Examiner*—Danielle Dunn
(74) *Attorney, Agent, or Firm*—William L. Androlia; H. Henry Koda

(57) ABSTRACT

A vehicular headlamp 1 including a projection lens 16 installed on the optical axis Ax extending in the longitudinal direction of the vehicle a light source 12*a* provided behind the rear side focal point F of the projection lens 16, and a reflector 14 that reflects direct light from the light source 12*a* forward and toward the optical axis Ax; and in this headlamp, an additional lens 30, which deflects and directs light from the light source 12*a* to the front is provided around the outer perimeter of the projection lens 16, and grooves 33, which have side faces that direct at least a part of the incident light toward the side of the vehicle, are formed in the outer surface of the additional lens 30.

6 Claims, 9 Drawing Sheets

VEHICULAR HEADLAMP

BACKGROUND OF THE INVENTION

1. Field of the Invention

The present invention relates to a projector-type vehicular headlamp.

2. Description of the Related Art

Generally, in a projector-type vehicular headlamp, a projector lens is disposed on an optical axis that extends in the longitudinal direction of a vehicle, and a light source is provided on the rear side of the rear side focal point of the projection lens so that light from the light source is reflected by a reflector toward the optical axis.

FIG. 9 shows a conventional example of this type of projector-type vehicular headlamp.

The vehicular headlamp 101 of FIG. 9, disclosed in U.S. Patent Application Publication No. US 2005/0190572 A1, includes a projection lens 102 that is disposed on an optical axis Ax extending in the longitudinal direction of the vehicle, a light source bulb 103 that is provided on the rear side of behind the rear side focal point F of the projection lens 102, a reflector 104 that reflects direct light from the light source bulb 103 forward and toward the optical axis Ax, and an additional lens 105 that is mounted in the form of a ring around the outer perimeter of the projection lens 102.

The additional lens 105 directs light, which is radiated from the light source bulb 103 to the outer perimeter of the projection lens 102, forward in a form of light that is roughly parallel to the optical axis Ax.

When an ordinary projector-type vehicular headlamp is lit, light is emitted from and visible through only the projection lens. However; as shown in FIG. 9, if the additional lens 105 is provided around the outer perimeter of the projection lens 102, the light-emitting surface area of the entire lamp can be enlarged to such an extent that the additional lens 105 directs the light forward. Accordingly, the lamp has an increased better visibility to drivers of oncoming vehicles and the like, thus improving safety when the vehicle is running.

However, the additional lens 105 used in the lamp of FIG. 9 is a lens that forwardly directs light which reaches the outer perimeter of the projection lens 102 and is thus not utilized by or enter the projection lens 102. As a result, the additional lens 105 does not direct light to the side of the vehicle.

Thus, the problem with this lamp is that it cannot contribute to enhance the visibility of the vehicle to the pedestrians or the like who are on the lateral side of the vehicle.

BRIEF SUMMARY OF THE INVENTION

Accordingly, the object of the present invention is to provide a vehicular lamp that is free of the problems seen in the above-described conventional vehicular lamp.

More specifically, the object of the present invention is to provide a vehicular lamp in which the light-emitting surface area of the entire lamp is enlarged and light is radiated also to the area on the side of the vehicle in addition to the area in front of the vehicle, thus improving the visibility of the lamp to not only drivers of oncoming vehicles and pedestrians in front of the vehicle but also to pedestrians on the side of the vehicle The above object is accomplished by a unique structure of the present invention for a vehicular headlamp that includes, in a lamp chamber formed by a lamp body and a front cover, a projection lens installed on the optical axis extending in the longitudinal direction of a vehicle, a light source provided on the rear side of behind the rear side focal point of the projection lens, and a reflector for reflecting direct light from the light source forward and toward the optical axis; and in the present invention, the headlamp further includes:

an additional lens provided on at least a part of the circumference of the projection lens so as to deflect and direct light from the light source forward, and a deflecting portions formed on the outer surface of the additional lens so as to direct at least a part of the incident light toward the side of the vehicle.

Accordingly, in the vehicular headlamp of the present invention, when it is lit, not only the projection lens but also the additional lens around the outer perimeter of the projection lens appear to emit light, and thus the headlamp has a larger light-emitting surface area and an improved exterior appearance.

Moreover, in the above-described lamp of the present invention, light from the light source and the reflector that is directed to the outer perimeter of the projection lens is not utilized by the projection lens for forward radiation but is utilized by the additional lens for forward radiation. Accordingly, the use efficiency of the light from the light source improves.

Furthermore, the additional lens not only directs the incident light from the light source and the reflector forward, but also, by means of the deflecting portions, directs a part of the light to the side of the vehicle. As a result, radiation of light to the side of the vehicle is accomplished in addition to radiation to the front of the vehicle, and the visibility of the lamp not only to drivers of oncoming vehicles and pedestrians in front of the vehicle but also to pedestrians or the like on the side of the vehicle improves.

Moreover, when the moderate amount of light is directed from the additional lens toward the front of the vehicle and upward by the deflecting portions, the upward-directed light functions as radiated light (overhead sign radiated light) that illuminates overhead signs that are installed above the road surface in front of the vehicle, making the overhead signs greatly visible.

In the vehicular headlamp of the present invention described above, it is preferable that the deflecting portions be comprised of side faces of grooves that are formed in the outer surface of the additional lens.

With this configuration, the sizes and number of the grooves formed in the outer surface of the additional lens can be modified to change the amount of light radiated to the front and the amount of light radiated to the side, and adjustment of the amounts of light to the front and side of the vehicle is accomplished easily.

In the present invention, the deflecting portions can be formed by side faces of convex portions that are formed on the outer surface of the additional lens.

With this configuration, the sizes and number of the convex portions formed on the outer surface of the additional lens can be modified to change the amount of light radiated to the front and the amount of light radiated to the side, and adjustment of the amounts of light to the front and side of the vehicle is accomplished easily.

Furthermore, in the present invention, the deflecting portions can be formed by side faces of raised portions that are formed on the outer surface of the additional lens.

With this configuration, the sizes and number of the raised portions formed on the outer surface of the additional lens can be modified to change the amount of light radiated to the front and the amount of light radiated to the side, and adjustment of the amounts of light to the front and side of the vehicle is accomplished easily.

Furthermore, in the vehicular headlamp of the present invention, it is preferable that deflecting portions that directs light upward be formed with totally reflective faces.

With this configuration, there will be no upward radiation of light from the additional lens, and glare that is caused by upward radiation is prevented.

As seen from the above, in the vehicular headlamp of the present invention, when the headlamp is lit, not only the projection lens but also the additional lens around the outer perimeter of the projection lens, appears to emit light. Accordingly, the headlamp has expanded light-emitting surface area and an improved appearance.

Moreover, though the light from the light source and the reflector that is directed to the outer perimeter of the projection lens is not utilized by the projection lens for forward radiation, such light, instead, is utilized for forward radiation by the additional lens. Accordingly, the headlamp of the present invention has an improved use efficiency of the light emitted by the light source.

Furthermore, the additional lens not only directs the incident light from the light source and the reflector forward but also, by means of the deflecting portions, directs a part of such light to the side of the vehicle. Accordingly, radiation to the side of the vehicle is accomplished in addition to radiation of light to the front of the vehicle, and this improves the visibility of the lamp not only to drivers of oncoming vehicles and pedestrians in front of the vehicle but also to pedestrians, vehicles, etc. on the lateral side of the vehicle.

DETAILED DESCRIPTION OF THE INVENTION

Embodiments of a vehicular headlamp according to the present invention will be described below in detail with reference to the accompanying drawings.

Figure 1:
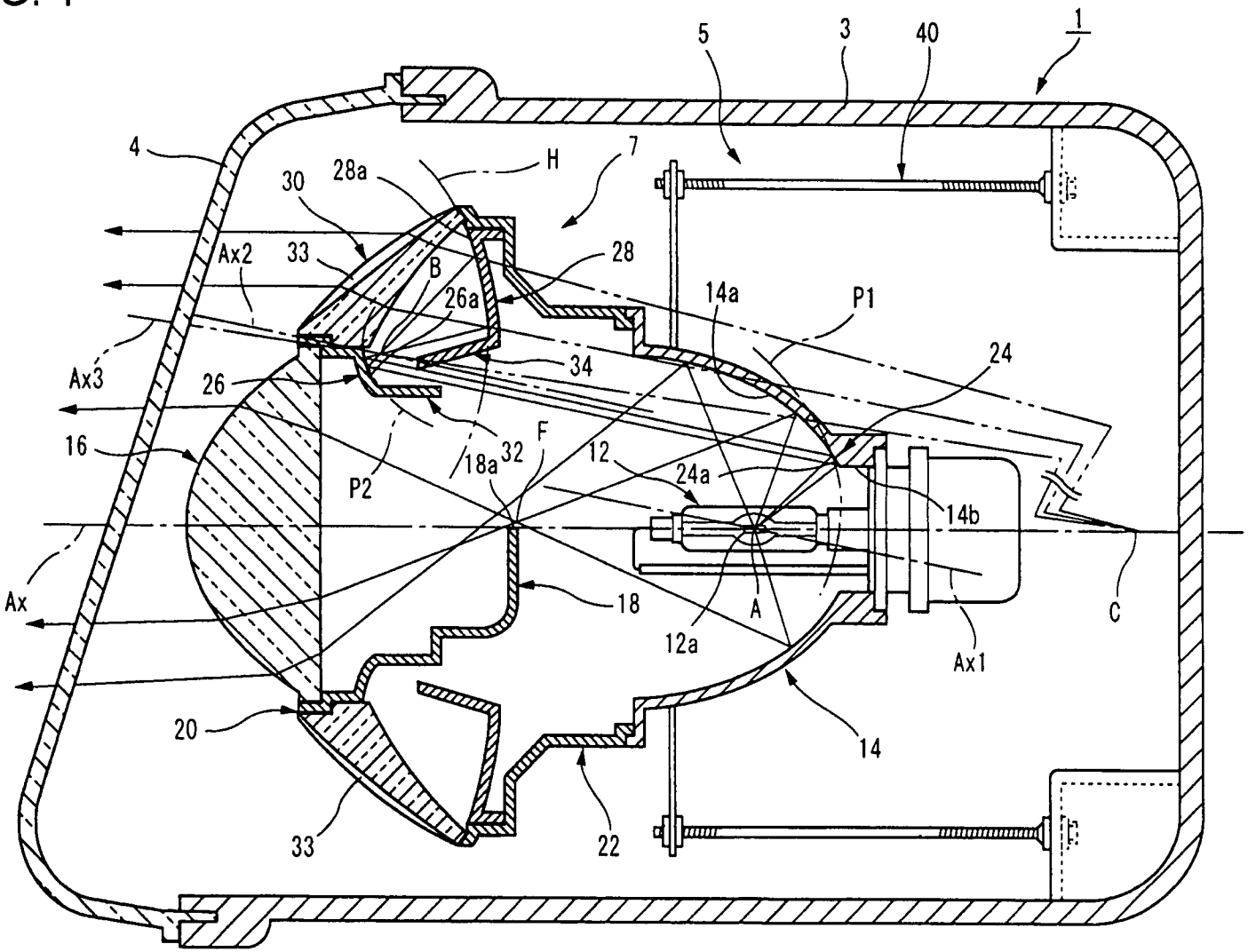
FIG. 1 is a vertical cross-sectional view of the vehicular headlamp according to one embodiment of the present invention.
Figure 2:
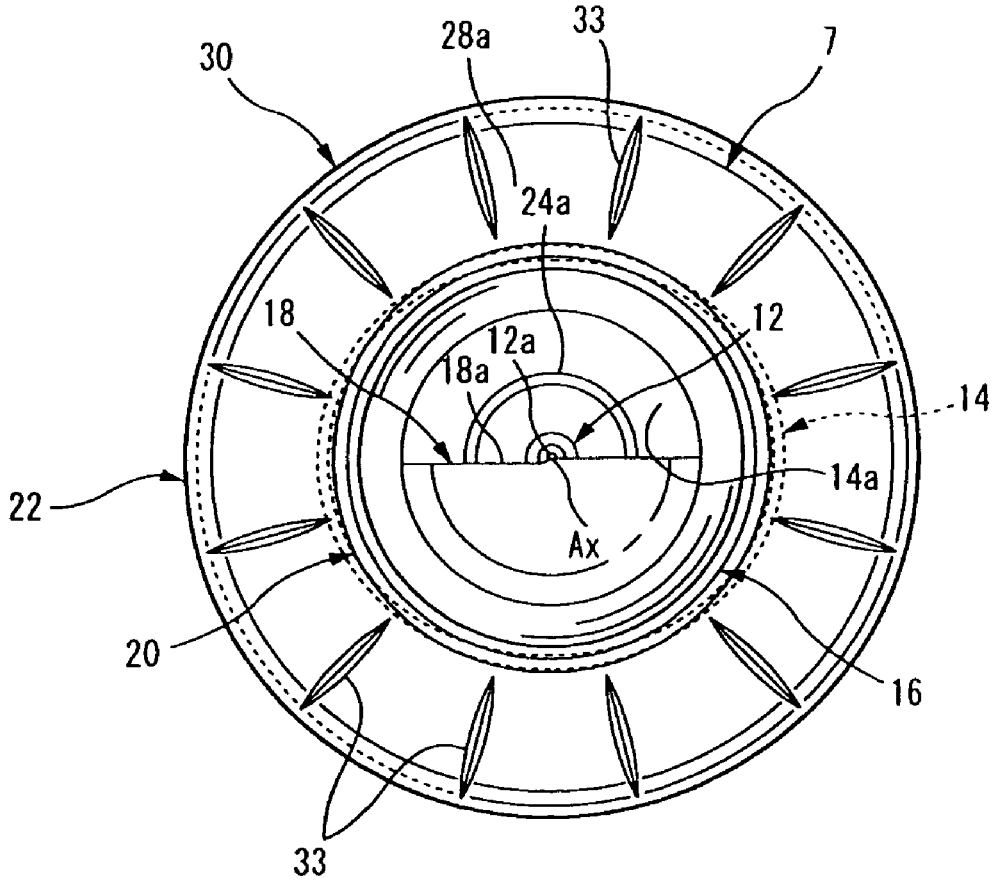
FIG. 2 is a front view of the lamp unit of the vehicular headlamp shown in FIG. 1.
Figure 3:
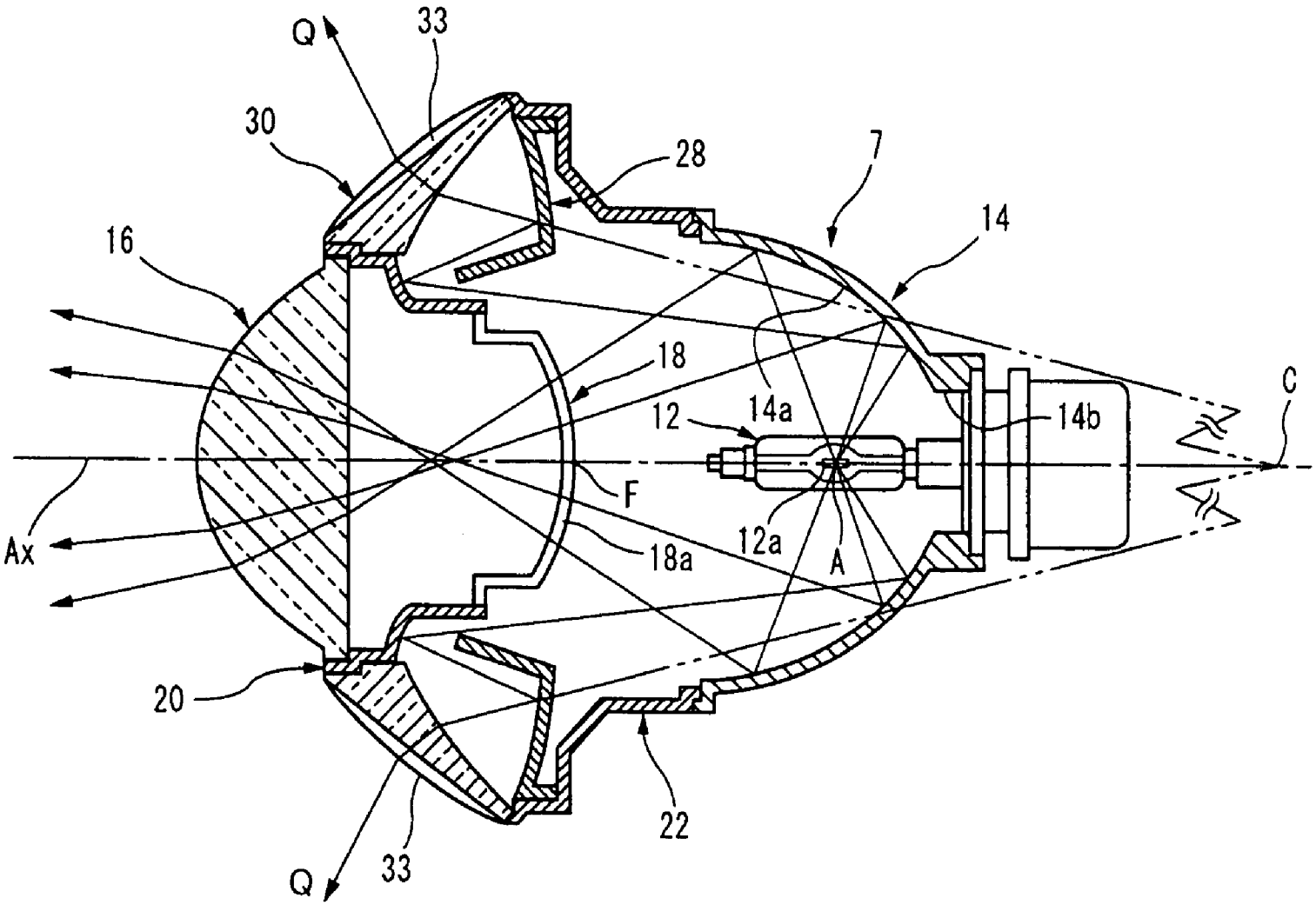
FIG. 3 is a horizontal sectional view of the lamp unit of the vehicular headlamp shown in FIG. 1.

FIG. 1 is a vertical cross-sectional view of a vehicular headlamp according to the embodiment of the present invention. FIG. 2 is a front view of the projection lens and additional lens of the headlamp shown in FIG. 1, and FIG. 3 is a horizontal sectional view of the lamp unit of the headlamp of FIG. 1.

In the vehicular headlamp 1, as seen from FIG. 1, a projector-type lamp unit 7 is accommodated inside a lamp chamber 5 that is formed by a lamp body 3 and a generally plain transparent front cover (front cover) 4 that is mounted on the front opening of the lamp body 3.

The lamp unit 7 is supported by the lamp body 3 via an aiming mechanism 40. The aiming mechanism 40 is a mechanism for finely adjusting the mounting position and mounting angle of the lamp unit 7. When the adjustment of the mounting position and the mounting angle is completed, the lens central axis (optical axis) Ax of the lamp unit 7 is set to extend at a downward angle of approximately 0.5 to 0.6 degrees with respect to a horizontal plane.

The projector-type lamp unit 7 radiates light to form a low-beam light distribution pattern, and it includes a light source 12*a*, a reflector 14, a projection lens 16, a shade 18, a first holder 20, a second holder 22, a first additional reflector 24, a second additional reflector 26, a third additional reflector 28, an additional lens 30, a first shade member 32, and a second shade member 34. The optical axis Ax of the lamp unit 7 extends in the longitudinal direction of a vehicle.

The projection lens 16 is a planoconvex a spherical lens, and thus its front surface is convex, and the rear surface is flat. The center of the projection lens 16 is positioned on the optical axis Ax of the lamp unit 7. An image on a focal plane that includes the rear side focal point F is projected by the projection lens 16 onto an imaginary vertical screen in front of the lamp as an inverted image. The projection lens 16 is fixed and supported at its outer perimeter edge by the ring-shaped first holder 20.

The light source 12*a* of the projector-type lamp unit 7 is a discharging light source of the light source bulb 12. The light source bulb 12 is a discharge bulb, such as a metal halide bulb or the like, and is inserted in a rear opening 14*b* of the reflector 14. The light source 12*a* is configured as a line segment light source on the optical axis Ax and extends along the optical axis Ax.

A halogen bulb or the like can be used for the light source bulb 12 instead of a discharge bulb that is described above, and an LED or the like can be also used as the light source.

The reflector 14 is formed with a reflective surface 14*a* for reflecting light from the light source 12*a* forward and toward the optical axis Ax. The reflective surface 14*a* has a cross section that is generally ellipsoidal shape in a horizontal plane that includes the optical axis Ax, and the eccentricity of the reflective surface 14*a* gradually increases from a vertical cross section to a horizontal cross section thereof. Therefore, within the vertical cross section, light from the light source 12*a* that is reflected by the reflective surface 14*a* generally converges in the vicinity of the rear side focal point F, while within the horizontal cross section, the convergence position is displaced forward from the rear side focal point F.

The shade 18 is formed as a single piece with the first holder 20 and extends to the rear side from generally the lower half of the first holder 20. The shade 18 is disposed so that the top edge 18*a* passes through the rear side focal point F of the projection lens 16. The shade 18, therefore, blocks a part of the light that is reflected by the reflective surface 14*a* of the reflector 14, thus excluding most of the upwardly directed light that would be directed forward by the projection lens 16. The top edge 18*a* of the shade 18 is formed in a stepped fashion to the left and the right and extends in a generally circular arc in the horizontal direction along the rear side focal plane of the projection lens 16.

The first additional reflector 24 is provided on the rear side of the light source 12*a* and above the optical axis Ax, and it reflects light from the light source 12*a* forward in a direction away from the optical axis Ax. The first additional reflector 24 is formed in a single piece with the reflector 14. The reflective surface 24*a* of the first additional reflector 24 extends in a circular arc around the inside perimeter edge of the reflective surface 14*a* of the reflector 14 and around the rear opening 14*b*.

The cross section of the reflective surface 24*a*, which lies in a plane that includes the optical axis Ax, forms a first parabola P1, which includes, as its focal point, a center of light emission A of the light source 12*a* and, as its axis, an axis Ax1, which is inclined with respect to the optical axis Ax. The reflective surface 24*a*, as a result, reflects light from the light source 12*a* as parallel beams.

Both circumferential edges of the reflective surface 24*a* are formed so that they are slightly above the horizontal plane that includes the optical axis Ax. Therefore, the portions of the reflective surface 14*a* of the reflector 14 that are positioned to the left and right of the optical axis Ax provide reflective areas to form a low-beam light distribution pattern.

The second additional reflector 26 is provided near the rear portion of the projection lens 16 and near the outer perimeter edge of the projection lens 16. The second additional reflector 26 reflects light from the light source 12*a* that has been reflected by the first additional reflector 24, thus directing the light rearward in a direction away from the optical axis Ax.

The second additional reflector 26 is a ring-shaped member centered around the optical axis Ax, and it is formed as a single piece with the first holder 20. The reflective surface 26*a* of the second additional reflector 26 is formed around the entire outer perimeter edge of the projection lens 16. However, because the reflective surface 24*a* of the first additional reflector 24 is positioned above the optical axis Ax, light from the light source 12*a* that is reflected by the first additional reflector 24 strikes, as seen from FIG. 1, the reflective surface 26*a* of the second additional reflector 26 only in the area above the optical axis Ax.

The cross section of the reflective surface 26*a*, which lies in a plane including the optical axis Ax, forms a second parabola P2, which includes, as its focal point, a point B near the rear portion of the second additional reflector 26 and, as its axis, an axis Ax2, which is parallel to the axis Ax1 of the first parabola P1. As a result, the parallel beams from the first additional reflector 24 are reflected as beams that converge at the focal point B of the second parabola P2.

The third additional reflector 28 is provided near the rear portion of the second additional reflector 26, and it reflects light from the first additional reflector 24 that has been reflected by the second additional reflector 26, thus directing the light forward.

The third additional reflector 28 is a ring-shaped member centered around the optical axis Ax, and it is fixed and supported by the second holder 22. The reflective surface 28*a* of the third additional reflector 28 is configured such that it faces the reflective surface 26*a* of the second additional reflector 26 around its entire circumference.

The cross section of the reflective surface 28*a* that lies in a plane including the optical axis Ax forms a hyperbola H, which is one of a pair of hyperbolas that include, as its first focal point, the focal point B of the second parabola P2 and, as its second focal point, a point C that is positioned on the optical axis Ax well on the rear side of the light source 12*a*; and the hyperbola H is a hyperbola on the first focal point B side. The hyperbola H has, as its axis, an axis Ax3, which is inclined with respect to the optical axis Ax at an angle that is slightly less than the angle at which the axis Ax1 of the first parabola P1 is inclined with respect to the optical axis Ax.

The reflective surface 28*a* of the reflector 28 reflects light, that has been reflected by the second additional reflector 26, has converged at the first focal point B and then strikes the reflective surface 28*a* as diverging beams from the first focal point B and being reflected, as beams diverging from the second focal point C of the pair of hyperbolas.

The additional lens 30 is provided near the outer perimeter of the projection lens 16, and it deflects the reflected light from the second additional reflector 26 that has been reflected by the third additional reflector 28; as a result the light is directed forward as beams parallel to the optical axis Ax. The additional lens 30 is provided in a ring shape around the entire circumference of the outer perimeter edge of the projection lens 16 as a ring-shaped lens that has a generally wedge-shaped cross section made up of a perimeter edge portion of a convex meniscus lens.

The additional lens 30 is fixed and supported at its inside perimeter edge by the first holder 20 and is fixed and supported at its outer perimeter edge by the second holder 22. The additional lens 30 is disposed so that its focal point is positioned on the second focal point C of the pair of hyperbolas. As a result, the light reflected by the third additional reflector 28 strikes the additional lens 30 as beams diverging from the second focal point C.

The light, which is reflected by the third additional reflector 28 and strikes the additional lens 30, is light for which the second focal point C of the pair of hyperbolas serves as a false light source, and thus the light is diverging beams that are close to parallel beams. Accordingly, even a small refractive power of the additional lens 30 is sufficient to make the beams of light parallel to the optical axis Ax, and thus the thickness of the additional lens 30 is comparatively thin.

On the outer surface of the additional lens 30, as shown in FIG. 2, a plurality of radially-oriented grooves 33 extending in the longitudinal direction (see FIG. 1) of the vehicle are formed at appropriate intervals in the circumferential direction.

The grooves 33 have substantially V-shaped cross sections, and side faces of the grooves 33 serve as deflecting portions that direct at least a part of the light, which strikes the additional lens 30 from the third additional reflector 28, toward the side of the vehicle.

As seen from FIG. 3, light Q, which the side faces of the grooves 33, as deflecting portions, direct to the lateral side of the vehicle, increases the light-emitting surface area that faces the side of the vehicle, so that light emission by the additional lens 30 can be more easily noticed by pedestrians on the side of the vehicle, and the visibility of the lamp for pedestrians on the side of the vehicle is improved.

The second holder 22 has a circular ring shape, and it is fixed and supported at its rear edge by the reflector 14 as best seen from FIG. 3.

The first and second shade members 32 and 34 are provided near the rear portion of the second additional reflector 26 such that they restrict any light other than light from the light source 12*a*, which has been reflected by the first additional reflector 24, from striking the second additional reflector 26.

The first shade member 32 is formed as a single piece with the second additional reflector 26, and it extends in a circular cylindrical shape toward the rear side from the inside perimeter edge of the second additional reflector 26. The second shade member 34 is formed as a single piece with the third additional reflector 28, and it extends in a circular conical shape toward the front from the inside perimeter edge of the third additional reflector 28. A narrow, ring-shaped gap centered around the optical axis Ax is thus formed between the rear edge of the first shade member 32 and the front edge of the second shade member 34 as seen from FIG. 1 (and from FIG. 3).

With this structure, of the light from the light source 12*a* that is reflected by the first additional reflector 24, only the light that passes through the ring-shaped gap between the first shade member 32 and the second shade member 34 strikes the second additional reflector 26. Accordingly, the amount of light that strikes the additional lens 30 is reduced, and the first and second shade members 32 and 34 prevent yellow light, for which matters trapped in and accumulated at the bottom of a vessel chamber of the light source bulb 12 serves as a false light source, from striking the second additional reflector 26.

Furthermore, the first and second shade members 32 and 34 prevent light that is emitted directly from the light source 12*a* from striking the second additional reflector 26 and additional lens 30.

Figure 4:
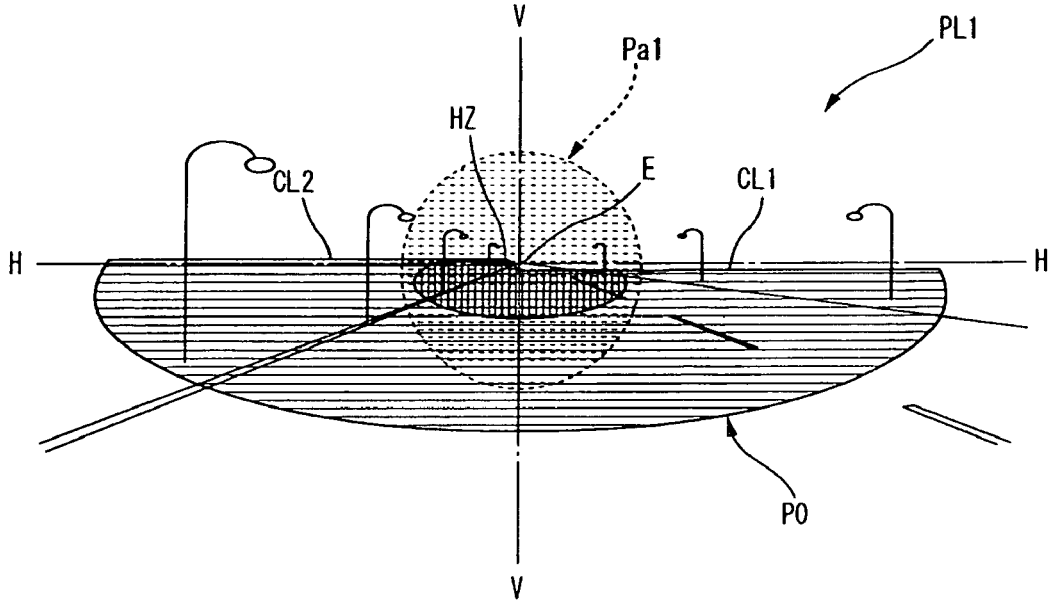
FIG. 4 is a diagram showing in perspective a light distribution pattern formed by light that is radiated forward from the vehicular headlamp shown in FIG. 1 on an imaginary vertical screen approximately 25 meters in front of the lamp.

FIG. 4 illustrates a low-beam light distribution pattern formed by light that is radiated forward from the vehicular headlamp 1 according to the shown embodiment on an imaginary vertical screen about 25 meters in front of the lamp.

The low-beam light distribution pattern PL1 of FIG. 4 is a low-beam light distribution pattern for the light distribution on the left side of a vehicle and is formed as a composite light distribution pattern made of a basic light distribution pattern PO and an additional light distribution pattern Pa1.

More specifically, the basic light distribution pattern PO is a light distribution pattern that forms the main portion of the low-beam light distribution pattern PL1 and is formed by the light emitted by the projection lens 16.

The basic light distribution pattern PO has in its top edge cut-off lines CL1 and CL2, which are formed in a stepped fashion on the left and right. The cut-off lines CL1 and CL2 extend in the horizontal direction in a stepped fashion to the left and right sides of the left-right boundary line V-V that passes perpendicularly through a vanishing point H-V in front of the lamp. The lower-level cut-off line CL1 is formed in the opposite lane on the right side of the boundary line V-V, and the upper-level cut-off line CL2, which steps up from the lower-level cut-off line CL1 via an inclined portion, is formed in the vehicle's own lane on the left side of the boundary line V-V.

In this light distribution pattern PO, an elbow point E, which is the point of intersection of the lower-level cut-off line CL1 and the boundary line V-V, is positioned approximately 0.5 to 0.6 degrees below H-V. This is because the optical axis Ax extends at a downward angle of approximately 0.5 to 0.6 degrees with respect to a horizontal plane as described above. Also, in this low-beam light distribution pattern PL1, a hot zone HZ, which is an area of high-intensity light, is formed so as to include therein the elbow point E.

The basic light distribution pattern PO is formed as an inverted projection image of a light source image that is formed on the rear side focal plane of the projection lens 16 (that is, the focal plane that includes the rear side focal point F) by light from the light source 12*a* that is reflected by the reflector 14. The cut-off lines CL1 and CL2 are formed as an inverted projection image of the top edge 18*a* (see FIG. 2) of the shade 18.

The additional light distribution pattern Pa1 is formed in addition to the basic light distribution pattern PO, and it is formed by the light directed forward by the additional lens 30.

Since the light that is directed forward by the additional lens 30 forms beams that are parallel to the optical axis Ax, the additional light distribution pattern Pa1 makes a spot-shaped light distribution pattern centered around the elbow point E. The additional light distribution pattern Pa1 extends above the cut-off lines CL1 and CL2; as a result, light emitted by the additional lens 30, together with stray light that is included in the light emitted by the projection lens 16, can strikes, for example, the eyes of drivers of oncoming vehicles.

As a result, the light-emitting surface area of the entire lamp appears greater than that of an ordinary projector-type vehicular headlamp by an amount of light emitted from the additional lens 30, increasing the visibility of the lamp. However, since the amount of light emitted from the additional lens 30 to form the additional light distribution pattern Pa1 is small, the light does not contribute to glare for, for example, drivers of oncoming vehicles.

As seen from the detailed above-description, the vehicular headlamp 1 of the shown embodiment is configured so that the light from the light source 12*a*, which is installed on the optical axis Ax and on the rear side of the rear side focal point F of the projection lens 16 that is installed on the optical axis Ax extending in the longitudinal direction of the vehicle, is reflected forward and toward the optical axis Ax by the reflector 14; and in addition, the first additional reflector 24 is provided on the rear side of the light source 12*a*, so that the first additional reflector 24 reflects light from the light source 12*a* forward in a direction away from the optical axis Ax.

Furthermore, the second additional reflector 26 is provided near the rear portion of the projection lens 16 and near the outer perimeter edge of the projection lens 16, so that the second additional reflector 26 reflects light from the light source 12*a* that has been reflected by the first additional reflector 24, directing the light rearward in a direction away from the optical axis Ax. In addition, the third additional reflector 28 is provided on the rear side of the second additional reflector 26, so that the third additional reflector 28 reflects light reflected by the first additional reflector 24 and has been reflected by the second additional reflector 26, thus directing the light forward. Moreover, the additional lens 30, with a generally wedge-shaped cross section, is provided on the outer perimeter of the projection lens 16, so that the additional lens 30 deflects the reflected light from the second additional reflector 26 that has been reflected by the third additional reflector 28, thus directing the light forward as beams parallel to the optical axis Ax.

As seen from the above, in the headlamp of the present invention, after the light from the light source 12*a* is reflected by the first, second, and third additional reflectors 24, 26 and 28 in sequence, it is directed forward as beams parallel to the optical axis Ax by the additional lens 30, which is provided on the outer perimeter of the projection lens 16. Accordingly, the light-emitting surface area of the entire lamp is greater than that of an ordinary projector-type vehicular headlamp by the amount of light emitted from the additional lens 30. Thus, the headlamp has an increased visibility to, for example, drivers of oncoming vehicles.

More specifically, as seen from FIG. 4, the additional light distribution pattern Pa1 that is formed by the light that is emitted by the additional lens 30 extends above the cut-off lines CL1 and CL2. Accordingly, the light that is emitted by the additional lens 30 strikes, for example, the eyes of drivers of oncoming vehicles together with stray light that is included in the light that is emitted by the projection lens 16, and this improves safety when the vehicle is running.

Furthermore, increasing the light-emitting surface area also improves the appearance of the headlamp when it is on.

Though the light that is reflected by the first additional reflector 24 and strikes the second additional reflector 26 is not utilized by the projection lens 16 for forward radiation, it is utilized for forward radiation by the additional lens 30.

Thus, the headlamp 1 has improved use efficiency of the light emitted by the light source bulb 12.

Furthermore, the additional lens 30 of the shown embodiment not only directs light from the light source 12*a* and the reflector 14 forward but also directs a part of it to the side of the vehicle by means of deflecting portions that are formed by the side faces of the grooves 33 formed in the outer surface of the additional lens 30. Accordingly, radiation to the side of the vehicle, as well as to the front of the vehicle, is performed; and this improves the visibility not only to drivers of oncoming vehicles and pedestrians in front of the vehicle but also to pedestrians, vehicles, etc. on the side of the vehicle.

In the shown embodiment, the deflecting portions that direct light to the side of the vehicle are comprised of side faces of the grooves 33 which are formed in the outer surface of the additional lens 30. The sizes and number of the grooves 33 can be modified so as to change the amount of light radiated to the front and the amount of light radiated to the side. Thus, adjustment of the amounts of light to the front and side of the vehicle is accomplished easily.

Furthermore, the additional lens 30 has a wedge-shaped cross section. As a result, the additional lens can be easily installed in a manner that it follows the surface shape of the projection lens 16. This makes it possible to harmonize the design of the additional lens 30 and the projection lens 16 and to make the lamp more compact.

Also, a moderate amount of light is directed from the additional lens 30 toward the front of the vehicle and upward by the deflecting portions that are formed by the side faces of some of the grooves 33 that extend in the horizontal direction. The upward-directed light functions as radiated light (overhead sign radiated light) for illuminating overhead signs that are high above the road surface in front of the vehicle, making the overhead signs easily visible.

Furthermore, the light from the light source 12*a* strikes the additional lens 30 after being reflected by the first, second, and third additional reflectors 24, 26 and 28 in sequence; as a result, light from the light source 12*a* is narrowed down every time it is reflected by one of the additional reflectors, and this allows the amount of light striking the additional lens 30 after being reflected by the third additional reflector 28 to be set to a comparatively small and appropriate amount. Accordingly, it is possible to make the amount of light emitted by the additional lens 30 be an appropriate amount, and thus it is further possible to form the additional light distribution pattern Pa1, which functions as overhead sign radiated light, and prevents glare to, for example, drivers of oncoming vehicles.

As seen from the above, in the projector-type vehicular headlamp 1 of the shown embodiment, the additional lens 30. which increases the lamp's visibility, is provided so that it follows the surface shape of the projection lens 16 and so that the amount of light emitted from the additional lens 30 is prevented from becoming excessive. Accordingly, drivers of oncoming vehicles, for example, are not bothered by glare from the lamp In particular, in the vehicular headlamp 1, the additional lens 30 is provided around the outer perimeter edge of the projection lens 16 as a ring-shaped lens which is made up of a perimeter edge portion of a convex meniscus lens. Accordingly, it is possible to harmonize the design of the additional lens 30 and the projection lens 16 even more and to make the lamp even more compact.

Furthermore, in the above-described vehicular headlamp 1, the cross section of the reflective surface 24*a* of the first additional reflector 24, which the cross section lies in a plane including the optical axis Ax, forms the first parabola P1 that includes, as its focal point, the light emission point A of the light source 12*a*; and the cross section of the reflective surface 26*a* of the second additional reflector 26, which the cross section lies in a plane including the optical axis Ax, forms the second parabola P2 that includes, as its focal point, a point B near the rear portion of the second additional reflector 26 and, as its axis, an axis Ax2 which is parallel to the axis Ax1 of the first parabola P1; and further, the cross section of the reflective surface 28*a* of the third additional reflector 28, which the cross section lies in a plane that includes the optical axis Ax, forms the hyperbola H, which is one of a pair of hyperbolas that include, as its first focal point, the focal point B of the second parabola P2 and, as its second focal point, the point C which is positioned on the optical axis Ax well to the rear of the light source 12*a*, with such hyperbola H being a hyperbola on the first focal point B side; and moreover, the additional lens 30 is provided so that its focal point is positioned at the second focal point C of the above-described pair of hyperbolas.

Accordingly, in this vehicular headlamp 1, the focal length of the additional lens 30 can be increased; and increasing the focal length of the additional lens 30 makes it possible to direct forward, as beams parallel to the optical axis Ax, the light that strikes the additional lens 30 from the third additional reflector 28, even though the additional lens 30 in this embodiment is comparatively thin.

In addition, with the additional lens 30 that is formed small in thickness, it is possible to reduce the occurrence of surface sinks in the lens and increase its optical precision, even when the additional lens 30 is made of injection-molded transparent resin.

Furthermore, in the shown embodiment, the light emission point A of the light source 12*a* is positioned on the optical axis Ax, and the point C, which is the second focal point of the pair of hyperbolas and the focal point of the additional lens 30, is also positioned on the optical axis Ax. Accordingly, with the additional lens 30, which has a wedge-shaped cross section, formed to have the same cross section shape around its circumference, the light emitted from the additional lens 30 is formed into beams parallel to the optical axis Ax.

In the vehicular headlamp 1 of the shown embodiment, the first and second shade members 32 and 34, which restrict any light other than the light from the light source 12*a* that has been reflected by the first additional reflector 24 from striking the second additional reflector 26, are provided near the rear portion of the second additional reflector 26. Accordingly, the light distribution pattern Pa1 that is formed by the light emitted from the additional lens 30 is reliably prevented from becoming brighter than necessary.

In the meantime, in the case where, as in the above vehicular headlamp 1, the light source 12*a* is formed by a discharging light source of the light source bulb 12, which is a discharge bulb, there is concern that matters trapped in and accumulated at the bottom of the vessel chamber of the light source bulb 12 will serve as a false light source, causing the additional lens 30 to appear to emit yellow light. However, in the shown embodiment of the present invention, the first and second shade members 32 and 34 are provided, and they prevent yellow light, for which the accumulated trapped matter serves as a false light source, from striking the second additional reflector 26. Accordingly, it is possible to prevent the additional lens 30 from appearing to emit yellow light.

In the above embodiment, the reflective surfaces 26*a* and 28*a* of the second and third additional reflectors 26 and 28 are formed so as to surround the optical axis Ax entirely. However, it is possible for the reflective surface 26*a* of the second additional reflector 26 to be shaped as an arc spanning a predetermined angular range including a part which is struck by the light from the light source 12*a* that has been reflected by the first additional reflector 24.

Likewise, it is also possible for the reflective surface 28*a* of the third additional reflector 28 to be shaped as an arc spanning a predetermined angular range including a part that is struck by the light from the first additional reflector 24 that is reflected by the second additional reflector 26. However, with the reflective surfaces formed so as to entirely surround the optical axis Ax, the lamp has, when it is not lit, an improved appearance.

The specific structures of the deflecting portions that direct at least a part of the light that strikes the additional lens 30 to the side of the vehicle are not limited to the structure shown in the embodiment described above (in which the side faces of the grooves formed in the outer surface of the additional lens 30 make the deflecting portions).

For example, the deflecting portions can also be formed by side faces of convex portions that are formed on the outer surface of the additional lens 30 (as will be described below with reference to FIGS. 5 and 6). The convex portions can be structured such that their vertical cross sections are, for instance, the opposite V-shaped.

With this configuration, the sizes and number of the convex portions formed on the outer surface of the additional lens 30 can be modified to change the amount of light radiated to the front and the amount of light radiated to the side, and thus the adjustment of the amounts of light to the front and side of the vehicle is accomplished easily.

Furthermore, side faces of raised portions that are formed on the outer surface of the additional lens 30 can also be used as deflecting portions that direct at least a part of the light that strikes the additional lens 30 to the side of the vehicle (as will be described below with reference to FIGS. 5 and 6).

With this configuration, the sizes and number of the raised portions formed on the outer surface of the additional lens 30 can be modified to change the amount of light radiated to the front and the amount of light radiated to the side, and thus the adjustment of the amounts of light to the front and side of the vehicle is accomplished easily.

Moreover, in the embodiment above, the additional lens 30 has a circular ring-shaped structure that surrounds the entire circumference of the outer perimeter of the projection lens 16. However, the additional lens 30 may have a structure that covers only a part of the circumference of the projection lens 16.

Also, in the shown embodiment above, the light beams that strike the additional lens 30 are formed by the first additional reflector 24, the second additional reflector 26, and the third additional reflector 28; and light that is reflected by the reflector 14 and direct light from the light source 12*a* are prevented from striking the additional lens 30 by shading function of the first and second shade members 32 and 34.

However, if the amount of light can be adjusted to a range that does not risk the occurrence of glare or the like, then the first and second shade members 32 and 34 can be omitted, so that light that is reflected by the reflector 14 and direct light from the light source 12*a* strike the additional lens 30. Thus, by way of omitting at least one of the first shade member 32 and the second shade member 34, the lamp is simple in structure, and the manufacturing cost can be reduced.

Figure 5:
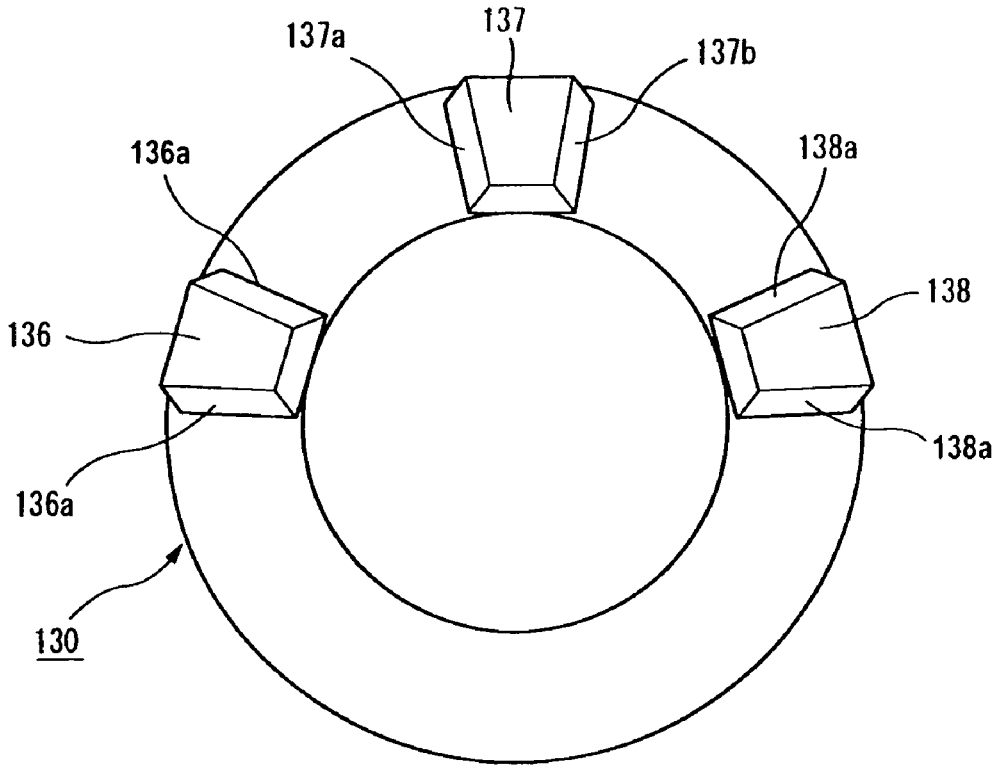
FIG. 5 is a front view of the additional lens used in the vehicular headlamp according to the present invention.
Figure 6:
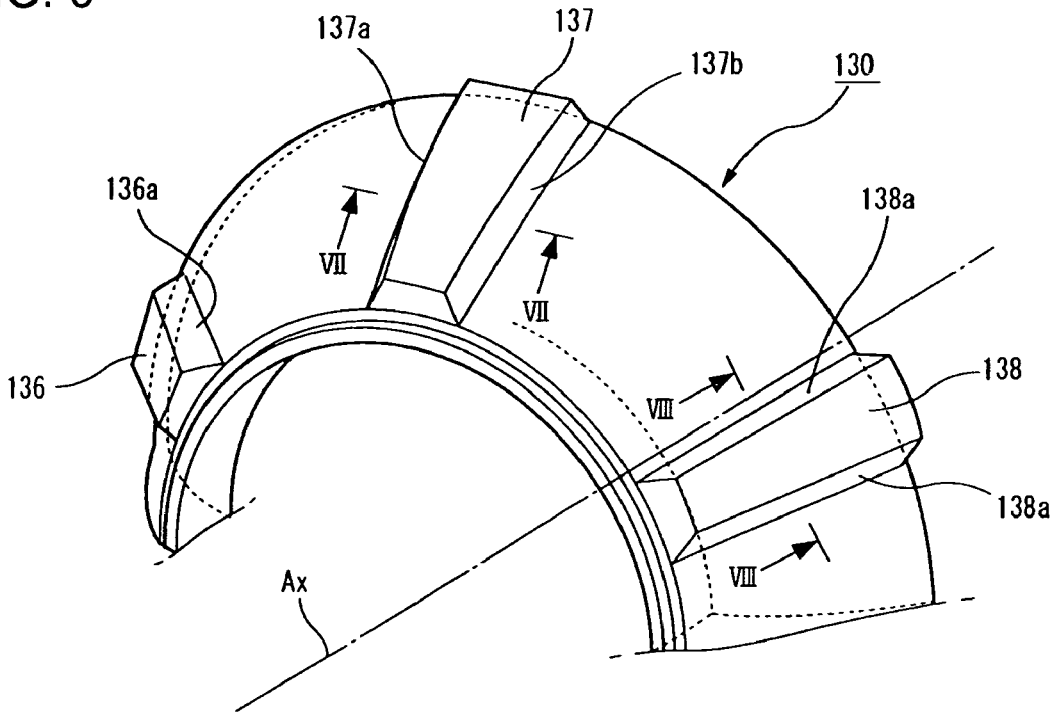
FIG. 6 is an enlarged perspective view of the additional lens shown in FIG. 5.

FIG. 5 and FIG. 6, respectively, show a ring-shaped additional lens 130 that encircles the vicinity of the outer perimeter of the projection lens 16 and is formed with three convex portions 136, 137 and 138 having trapezoid-shape horizontal cross sections.

Side faces 137*a* and 137*b* of the raised portions formed by convex portion 137 make the deflecting portions that direct at least a part of the light that strikes the additional lens 130 to the side of the vehicle.

The convex portion 137 is provided in a protruding fashion on the topmost portion of the outer surface of the additional lens 130, and the convex portions 136 and 138 are provided in a protruding fashion at generally symmetric positions with respect to the convex portion 137.

The faces that direct light to the side of the vehicle differ depending upon the positions the convex portions 136, 137 and 138 are formed.

Figure 7:
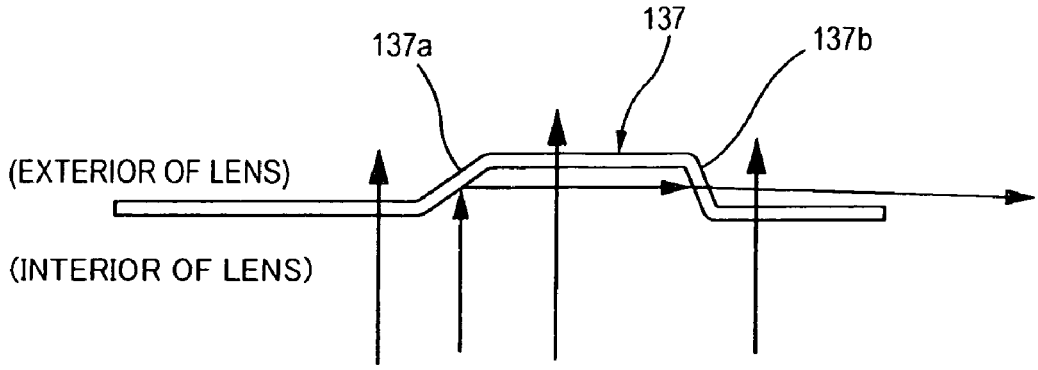
FIG. 7 is an explanatory diagram of the light transmission occurring in the convex portion of the additional lens, being a cross section taken along the line 7-7 in FIG. 6.

In the convex portion 137 which is provided on the topmost outer surface of the additional lens 130, as shown in FIG. 7, the side face 137*a* on one side is a totally reflective face that directs all light that strikes it toward the other side face 137*b* and does not direct any light to the outside. To the contrary, the side face 137*b* on the other side transmits all of the light reflected from the side face 137*a* to the outside (to the side of the vehicle). The side face 137*b* faces the left side in a headlamp that forms a low-beam light distribution pattern on the left side of the road. The purpose of this structure is to reduce the light that is radiated from the convex portion 137 to the oncoming vehicle lane.

Figure 8:
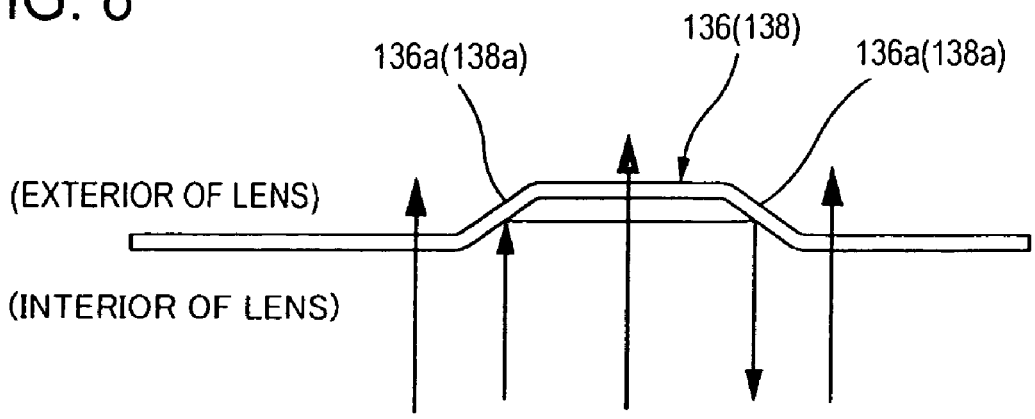
FIG. 8 is an explanatory diagram of the light transmission occurring in the convex portion of the additional lens, being a cross section taken along the line 8-8 in FIG. 6.
Figure 9:
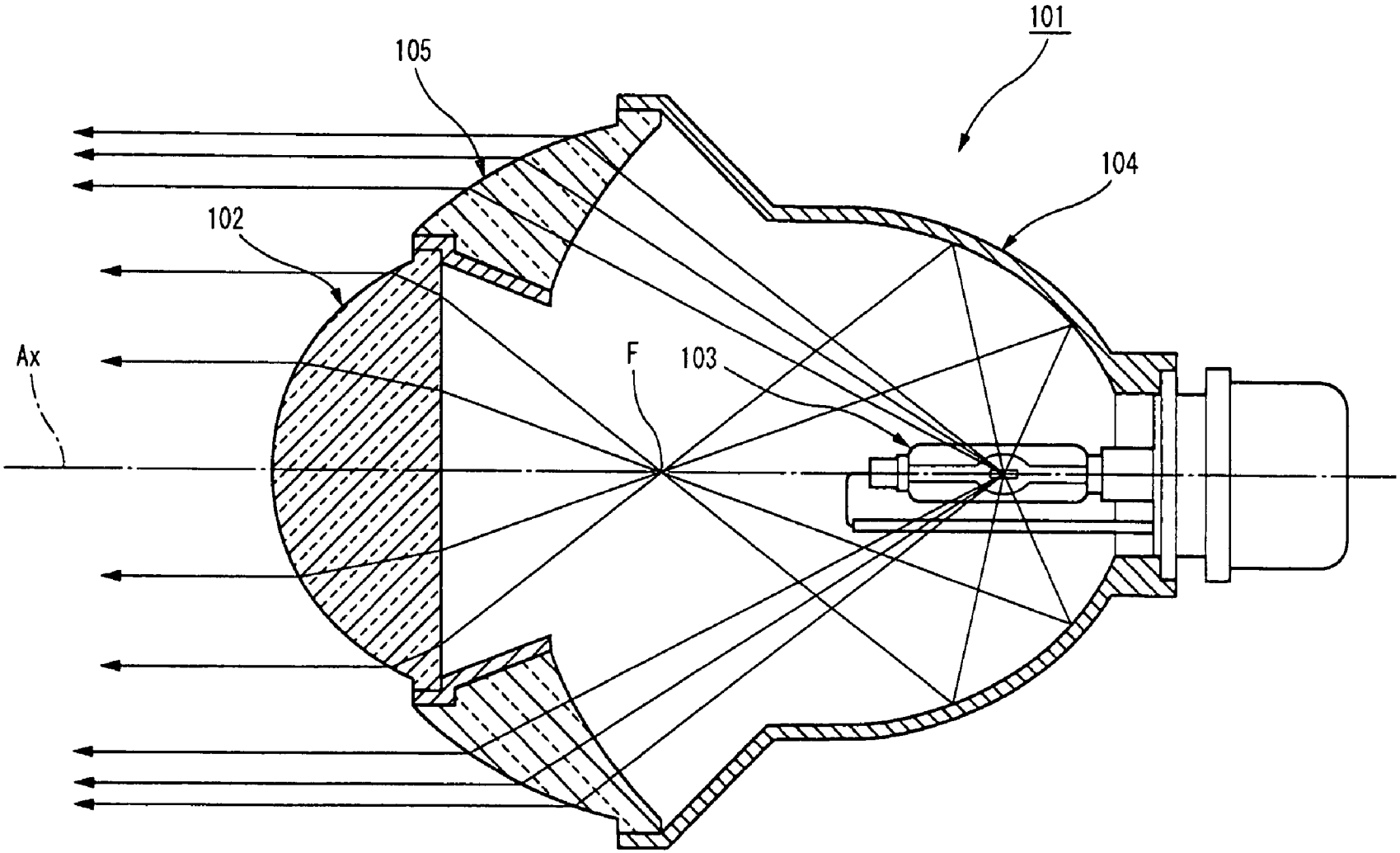
FIG. 9 is a vertical cross-sectional view of a conventional vehicular headlamp.

As shown in FIG. 8, in the convex portions 136 and 138 which are provided on either side of the convex portion 137, both inclined side faces 136*a* and 138*a* are totally reflective faces, so that they reflect all light into the interior of the additional lens 130 and do not transmit any light to the outside.

Thus, of the side faces 136*a*, 137*a*, 137*b* and 138*a*, which serve as deflecting portions on the outer surface of the additional lens 130 that direct light to the side of the vehicle, the side faces 136*a* and 138*a*, for which the orientation of the light is upward, are made totally reflective faces. Accordingly, the amount of light directed upward from the vehicle can be suppressed, and the occurrence of glare is prevented.

The invention claimed is:

1. A vehicle headlamp comprising;

a lamp chamber formed by a lamp body and a front cover, a projection lens installed on an optical axis extending in a longitudinal direction of a vehicle, a light source provided on a rear side of a rear side focal point of the projection lens, a reflector for reflecting direct light from the light source forward and toward the optical axis;

an additional lens provided on at least a part of a circumference of the projection lens so as to deflect and direct light from the light source forward; and a plurality of deflecting portions formed on the additional lens so as to direct at least a part of incident light toward a side of the vehicle, said plurality of deflecting portions extends along a radial axis on said additional lens.

2. The vehicular headlamp according to claim 1, wherein:

each of the plurality of deflecting portions is comprised of a side face of a radially extending grove formed in an outer surface of the additional lens.

3. The vehicular headlamp according to claim 1, wherein the deflecting portion is comprised of a side face of a convex portion formed on an outer surface of the additional lens.

4. The vehicular headlamp according to claim 1, wherein the deflecting portion is comprised of a side face of a raised portion formed on an outer surface of the additional lens.

5. The vehicular headlamp according to claim 1, wherein a part of the deflecting portion is comprised of a totally reflective face for directing a part of the incident light upward.

6. The vehicular headlamp according to claim 1 wherein said additional lens has a wedge shape cross-section.

* * * * *